US012781491B2

(12) United States Patent
Wang et al.

(10) Patent No.: US 12,781,491 B2
(45) Date of Patent: Nov. 3, 2026

(54) INTEGRATED CONTROL VALVE FOR SMART TOILET

(71) Applicant: XIAMEN R&J PRECISION TECHNOLOGY CO., LTD, Xiamen (CN)

(72) Inventors: Jinjiang Wang, Xiamen (CN); Yiming He, Xiamen (CN); Yanbin Xiao, Xiamen (CN); Zhaoxi Li, Xiamen (CN)

(73) Assignee: XIAMEN R & J PRECISION TECHNOLOGY CO., LTD

( * ) Notice: Subject to any disclaimer, the term of this patent is extended or adjusted under 35 U.S.C. 154(b) by 50 days.

(21) Appl. No.: 19/075,820

(22) Filed: Mar. 11, 2025

(65) Prior Publication Data

US 2025/0290305 A1 Sep. 18, 2025

(30) Foreign Application Priority Data

Mar. 12, 2024 (CN) ..... 202410281046.9

(51) Int. Cl.
*E03D 9/08* (2006.01)
*A47K 7/08* (2006.01)

(52) U.S. Cl.
CPC . *E03D 9/08* (2013.01); *A47K 7/08* (2013.01)

(58) Field of Classification Search
CPC ..... E03D 9/08; A47K 7/08
USPC ..... 4/420
See application file for complete search history.

(56) References Cited

U.S. PATENT DOCUMENTS 11,499,304 B1 * 11/2022 Bensing ..... F16K 11/08

* cited by examiner

*Primary Examiner* — Lauren A Crane

(57) ABSTRACT

An integrated control valve for a smart toilet is provided and comprises a valve shell, a driving member, a linkage assembly, a water distribution assembly and a water inlet assembly; the valve shell has a water inlet cavity and a water distribution cavity; the driving member is configured to drive the water distribution assembly to rotate circumferentially relative to the valve shell and drive the linkage assembly to move axially relative to the valve shell; the linkage assembly is configured to make the water inlet cavity be in communication with the water distribution cavity; the water distribution assembly is configured to make the water distribution cavity be in communication with any water outlet path. The integrated control valve for the smart toilet is provided to solve problems that the control valve of the existing smart toilet has many components, a large volume and high power consumption and so on.

14 Claims, 6 Drawing Sheets

INTEGRATED CONTROL VALVE FOR SMART TOILET

TECHNICAL FIELD

The present disclosure relates to the technical field of smart toilets, and in particular, to an integrated control valve for a smart toilet.

BACKGROUND

At present, an intelligent cover plate of an existing smart toilet is provided with independent control valve groups to control water intake, hip washing, women's washing, self-cleaning, and other functions. Generally, an electromagnetic valve group is used to control water intake; a distribution valve group or a plurality of electromagnetic switch valves are used to spray water for hip washing, women's washing, and self-cleaning. In a standby mode, the electromagnetic valve group that controls water intake is in a normally closed state. When receiving an opening signal, the electromagnetic valve group is powered on to open a water intake path, then water enters a distribution water channel and opens or clioses the hip washing, the women's washing, or the self-cleaning according to a control signal. However, the existing method has problems of excessive power consumption for opening, and high costs and large volume of the electromagnetic valve group, causing an increase in a height and costs of the entire intelligent cover plate. Especially, the power consumption is too high during opening. Since the electromagnetic valve group is designed to achieves a switch function, it is subject to water flow back pressure, and a high driving force is required to turn on the electromagnetic valve group. In this way, higher power is required to achieve opening or closing. In the event of power loss, it is difficult to achieve opening and closing through a backup energy storage capacitor, and there is a phenomenon of an opening failure. In addition, driving valve bodies of the distribution valve group or a plurality of electromagnetic switch valves to be opened and closed for hip washing, women's washing, and self-cleaning greatly reduces the reliability of use, and it is not easy to achieve continuous opening, ultimately leading to poor user experience of this product.

In summary, a control valve of an existing smart toilet still needs further improvement to meet practical use needs.

SUMMARY

The present disclosure aims to overcome the shortcomings or problems in the background section, and provides an integrated control valve for a smart toilet. This integrated control valve for a smart toilet has advantages of a simple structure, easy manufacturing, easy implementation, low costs, and can solve problems that the control valve of the existing smart toilet has many components, a large volume, high power consumption, and requires high driving power, and is not conductive to layout of the entire smart device.

To achieve the above objectives, the present disclosure uses the following technical solutions:

An integrated control valve for a smart toilet is provided. The integrated control valve comprises a valve shell, a driving member, a linkage assembly, a water distribution assembly, and a water inlet assembly;

the valve shell has a water inlet cavity and a water distribution cavity; one end of the water inlet cavity is in communication with a water inlet path, and the other end of the water inlet cavity is in communication with the water distribution cavity;

the driving member is arranged at the valve shell and is configured to: drive the water distribution assembly to rotate circumferentially relative to the valve shell and drive the linkage assembly to move axially relative to the valve shell;

the linkage assembly is configured to drive the water inlet assembly arranged inside the water inlet cavity to move axially relative to the valve shell, so as to cause the water inlet assembly to start or stop the communication between the water inlet cavity and the water distribution cavity; and the water distribution assembly moves circumferentially under the action of the driving member, so that the water distribution cavity can switch and be in communication with any water outlet path.

Further, the water outlet paths are respectively configured as a water outlet path for hip washing, a water outlet path for women's washing, and a water outlet path for self-cleaning.

Further, the linkage assembly comprises a bridging sleeve and a straight movable rod; one end of the bridging sleeve fixedly sleeves over an output shaft of the driving member, and the other end of the bridging sleeve is connected to the water distribution assembly; an outer circumferential wall of the bridging sleeve is provided with a ring slot, and a recessed portion is formed in the ring slot in an axial direction; one end of the straight movable rod acts on the water inlet assembly, and the other end of it is pressed inside the ring slot; when the driving member drives the bridging sleeve to rotate, the straight movable rod is linked to linearly move or swing in the axial direction of the valve shell, so that it can drive the water inlet assembly to move in the axial direction of the valve shell to open or close the water inlet cavity, and drive the water distribution assembly to switch between opening and closing of any water outlet path.

Further, the straight movable rod is limited by a limiting structure to move linearly in the axial direction relative to the valve shell; the limiting structure comprises a sliding chute provided in the valve shell and a sliding guide portion on the straight movable rod; and the sliding guide portion moves in the sliding chute to make one end of the straight movable rod to be confined in the ring slot and cause the water inlet assembly at the other end of the straight movable rod to move linearly in the axial direction of the valve shell.

Further, the water inlet assembly comprises a guide seat, a first membrane, and a pilot movable structure; a periphery of the guide seat is hermetically sleeved with the first membrane, and the water inlet cavity is divided into a water inlet chamber and a pressure stabilizing chamber by a scaling membrane; drainage holes for communicating the water inlet chamber with the pressure stabilizing chamber are correspondingly provided in the first membrane and the guide seat; the guide seat is located inside the pressure stabilizing chamber and has a pressure bearing surface; the pressure bearing surface is configured to withstand a water pressure to allow the first membrane to cover the water inlet chamber; the valve shell is further provided with a pressure relief hole; and the pressure relief hole is opened or closed under the action of the pilot movable structure.

Further, the pilot movable structure comprises a movable rod, a second membrane, and a scaling plug; one end of the movable rod is detachably and fixedly connected to the straight movable rod, and the scaling plug is arranged at the other end of the movable rod; the scaling plug corresponds to the pressure relief hole; the second membrane is hermetically sleeved between the movable rod and the valve shell, and can deform for sealing with the axial movement of the movable rod; and the pressure relief hole is in communication with the water distribution cavity.

Further, the pilot movable structure further comprises a compensation spring; the compensation spring sleeves over the movable rod and has two ends respectively acting on an inner surface of the valve shell and the movable rod.

Further, the water distribution assembly comprises a rotating member and a fixed member that are cooperate with each other; the fixed member is provided with water outlet holes which are correspondingly in communication with the water outlet paths; the rotating member is connected to the bridging sleeve in a non-rotation manner and is provided with a water passage hole; and the rotating member rotates with the bridging sleeve to drive the water passage hole in the rotating member to be in communication with any water outlet hole of the fixed member, so that water in the water distribution cavity is sprayed out from the corresponding water outlet holes.

Further, the water distribution assembly further comprises an elastic member; and two ends of the clastic member respectively act on the rotating member and the bridging sleeve to make the rotating member hermetically press against the fixed member.

Further, the driving member is a motor, and the motor is respectively connected to a power supply unit and a power storage capacitor.

According to the above description of the present disclosure, compared with the prior art, the present disclosure has the following beneficial effects:

The integrated control valve for the smart toilet provided by the present disclosure has advantages of a simple structure, easy manufacturing, easy implementation, low costs, and can solve problems that the control valve of the existing smart toilet has many components and a large volume, and requires high driving power, and is not conductive to layout of the entire smart device. The present disclosure changes the existing driving mode. Water inlet and outlet functions and switching functions of the components are achieved through one driving member only, so that the costs of the components are reduced, and a demand for power during opening or closing is lowered. The power for turning on or turning off the driving member is greatly reduced, which means that more power can be saved. In the event of power loss, a existing valve cannot work, unless a power storage battery is used to supply power, but the existing valve cannot be triggered to be turned on by a capacitor. It should be noted here that the power storage battery can open each existing electromagnetic valve once in the power loss state, but it has high costs and a large volume, which occupies a large space. This has a great impact on the design of the entire cover plate and hinder the production of a small-sized cover plate. The present disclosure uses the integrated design in which a plurality of structures are simultaneously driven to act in a synchronous and linked manner by one driving member. More importantly, the components have simple linkage structures and act and cooperate smoothly. In this way, it is stable in subsequent assembling, formation, and use. In addition, it greatly improves the layout of the entire intelligent cover plate. Furthermore, the linkage structure used in the present disclosure can synchronously achieve the switch function and the switching function to reduce a time difference, which makes the use experience better.

BRIEF DESCRIPTION OF DRAWINGS

To describe the technical solutions in the embodiments of the present disclosure more clearly, the following briefly describes the accompanying drawings required for describing the embodiments. Apparently, the accompanying drawings in the following description show some embodiments of the present disclosure, and a person of ordinary skill in the art may still derive other drawings from these accompanying drawings without creative efforts.

DETAILED DESCRIPTION OF THE EMBODIMENTS

Figure 1:
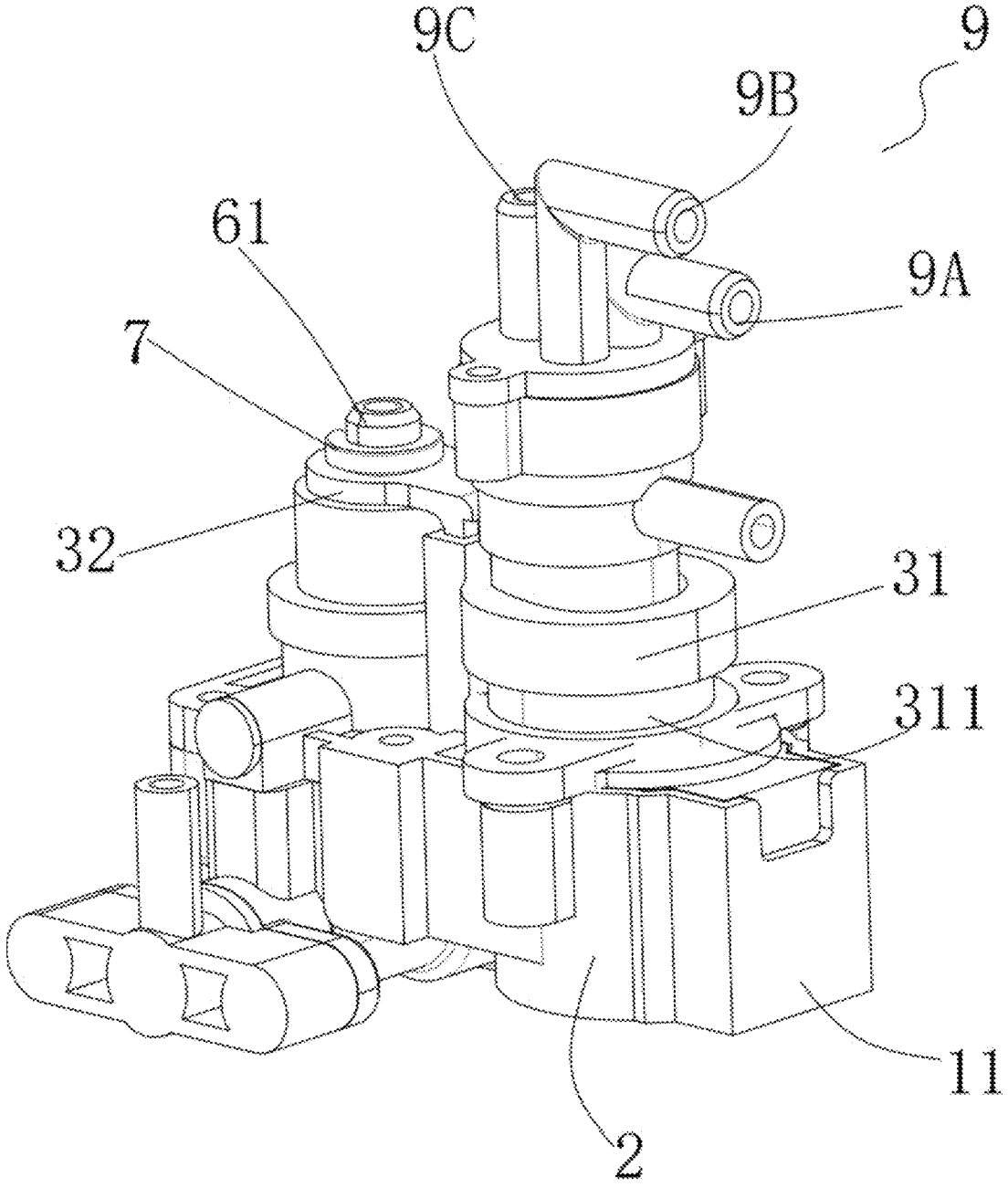
FIG. 1 is a schematic diagram of a three-dimensional structure of an integrated control valve according to the present disclosure.
Figure 2:
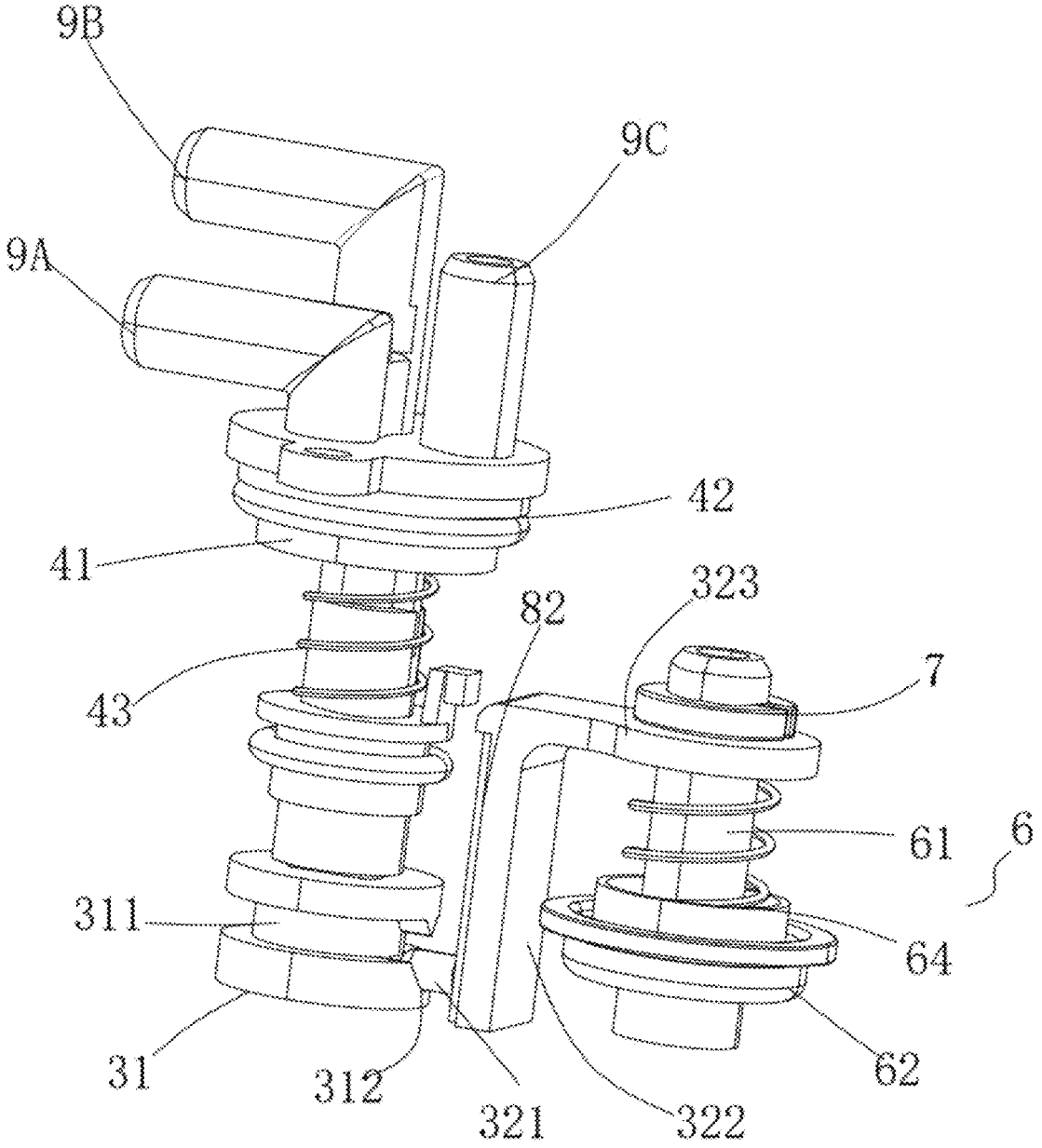
FIG. 2 is a schematic diagram of a three-dimensional structure of a linkage assembly and a water distribution assembly according to the present disclosure.

The technical solutions in the embodiments of the present disclosure are clearly and completely described below with reference to the accompanying drawings in the embodiments of present disclosure. Apparently, the described embodiments are preferable embodiments of the present disclosure, and should not be regarded as excluding other embodiments. All other embodiments obtained by a person of ordinary skill in the art based on the embodiments of the present disclosure without creative efforts shall fall within the protection scope of the present disclosure.

In the claims, this specification, and the above accompanying drawings of the present disclosure, unless otherwise explicitly specified, the terms "first", "second", "third", or the like used herein are to distinguish different objects, but are not intended to describe a specific order.

In the claims, this specification, and the above accompanying drawings of the present disclosure, unless otherwise explicitly specified, for the directional words, terms such as "center", "transverse", "longitudinal", "horizontal", "vertical", "top", "bottom", "inner", "outer", "up", "down", "front", "rear", "left", "right", "clockwise", and "anticlockwise", etc. used to indicate orientations or positional relationships is based on the orientations or positional relationships as shown in the drawings. These terms are only for the purpose of facilitating and simplifying the descriptions of the present disclosure, instead of indicating or implying that devices or elements indicated must have particular orientations or be constructed and operated in the particular orientations. So that these terms are not construed as limiting the specific protection scope of the present disclosure.

In the claims, this specification, and the above accompanying drawings of the present disclosure, unless otherwise explicitly limited, the terms such as "connection", "fixed connection" should be broadly understood, which means any connection mode between two elements without a displacement relationship or a relative rotation relationship, including non-removable fixed connection, detachable fixed connection, integrated connection, and fixed connection through other devices or elements.

In the claims, this specification, and the above accompanying drawings of the present disclosure, the terms "comprise", "include", "has", and their variations are intended to "include but not limited to".

As shown in FIG. 1, an integrated control valve for a smart toilet is provided. The integrated control valve is mainly configured to perform switchable water supplying on a water spray assembly (i.e. a spray rod). The switchable water supplying here includes turning on or turning off a water inlet assembly and introducing inlet water into a water distribution assembly for switching type distribution. A distribution and water outlet function is used for hip washing, women's washing, self-cleaning, and the like.

The integrated control valve in this embodiment includes a valve shell 1, a water inlet cavity 11, a water distribution cavity 12, a driving member 2, a linkage assembly 3, a water distribution assembly 4, and a water inlet assembly 5.

The valve shell 1 is injection-molded to form a shell body 13 and a cover body 14 that cooperate with each other to form a water inlet cavity 11, a water distribution cavity 12, and a position for assembling the driving member 2. It should be noted that one end of the water inlet cavity 11 is in communication with a water inlet path 111 (the water inlet path 111 here is in communication with a mixed water cavity or directly in communication with municipal water), and the other end of it is in communication with the water distribution cavity 12 (In this embodiment, the water inlet cavity 11 is in communication with the water distribution cavity 12 through a hose (not shown in the figure). That is, after the water inlet assembly 5 is turned on, water is introduced into the water distribution cavity 12).

The driving member 2 is arranged at the valve shell 1, and is configured to: drive the water distribution assembly 4 to rotate circumferentially relative to the valve shell 1 and drive the linkage assembly 3 to move axially relative to the valve shell 1. It should be noted that in this embodiment, the driving member 2 is exemplified by a motor 21 (such as a stepping motor and a servo motor. Or, certainly, the driving member 2 may be a mechanical mechanism, such as a wrench operated through a connection rod, which can act by manually driving the bridging sleeve 31 from the outside), and the motor 21 is connected to a power supply unit and a power storage capacitor (not shown in the figure) respectively. In a normal power-on state, the motor 21 is powered by the power supply unit. In a power loss state, the motor 21 can be driven to work by power in the capacitor. So it can ensure that the function of the motor 21 can be enabled normally. The present disclosure uses one driving member 2 (motor 21) to synchronously achieve a water inlet switching function and water outlet switching function, thus reducing a power supply quantity (which means saving electricity) and reducing power. This driving member 2 can be driven by the power storage capacitor.

During assembling, the motor 21 is arranged into the shell body 13, and an output shaft of the motor 21 is connected to a bridging sleeve 31 of the linkage assembly 3 in a non-rotation manner.

Figure 3:
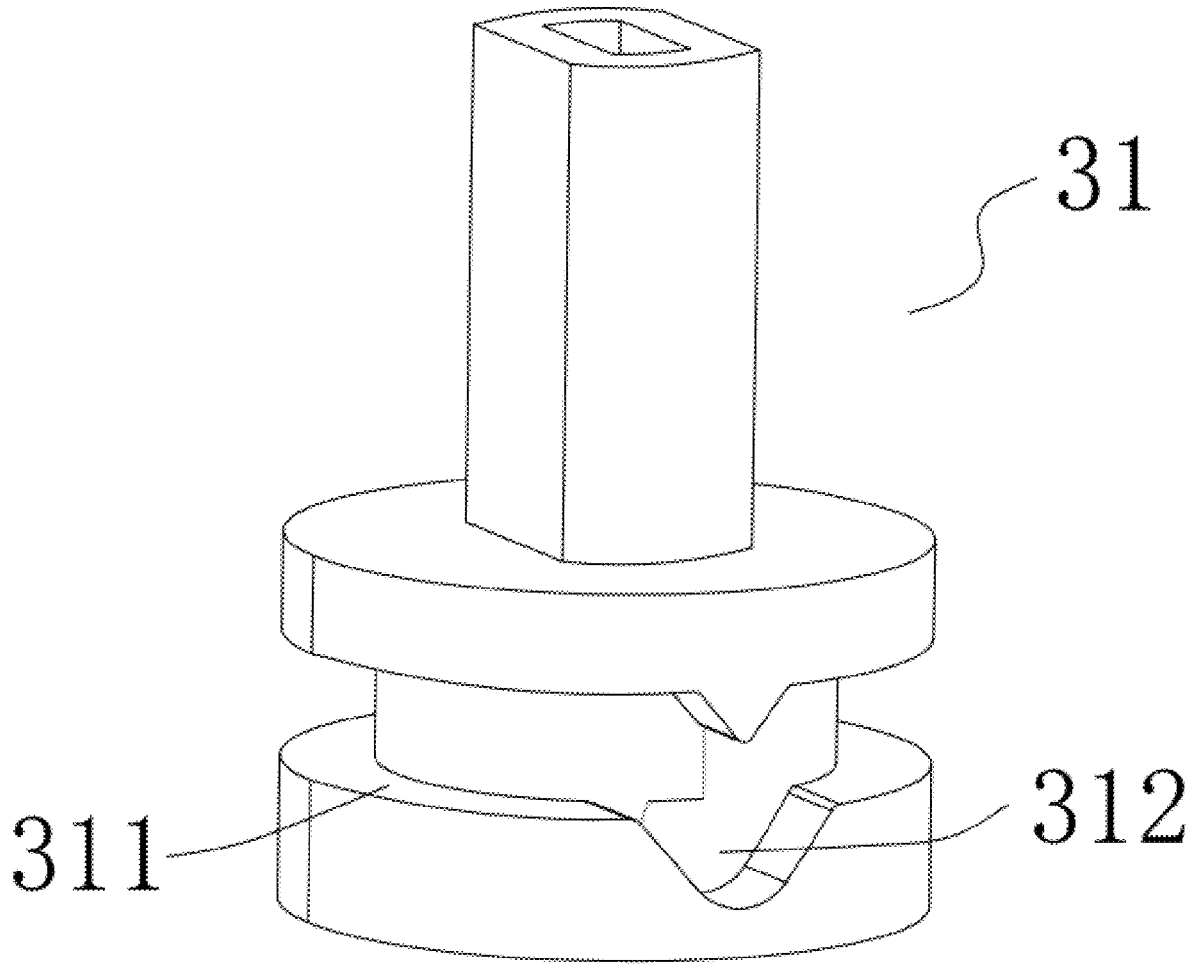
FIG. 3 is a schematic diagram of a three-dimensional structure of a bridging sleeve according to the present disclosure.
Figure 4:
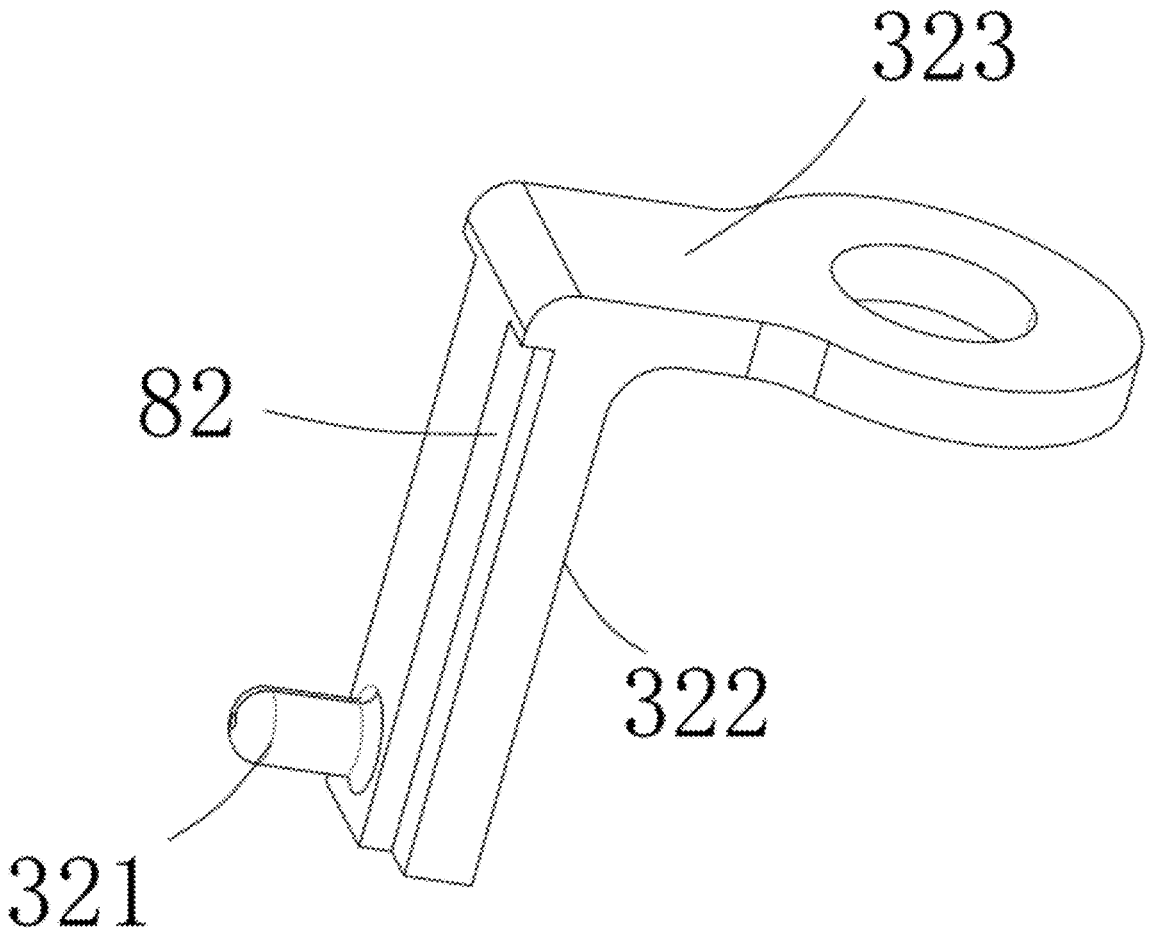
FIG. 4 is a schematic diagram of a three-dimensional structure of a straight movable rod portion according to the present disclosure.
Figure 5:
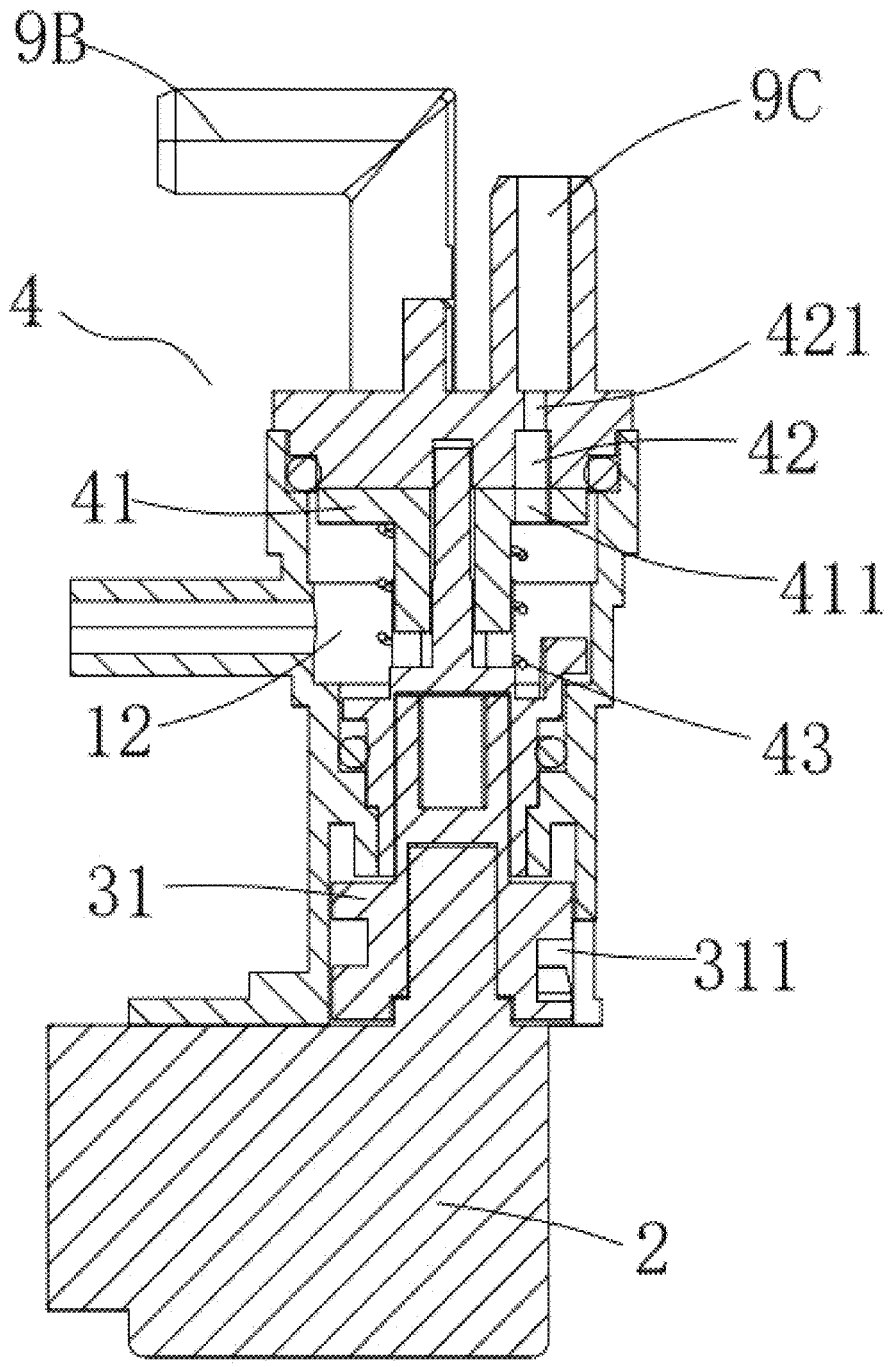
FIG. 5 is a cross-sectional view of a linkage assembly and a water distribution assembly according to the present disclosure.
Figure 6:
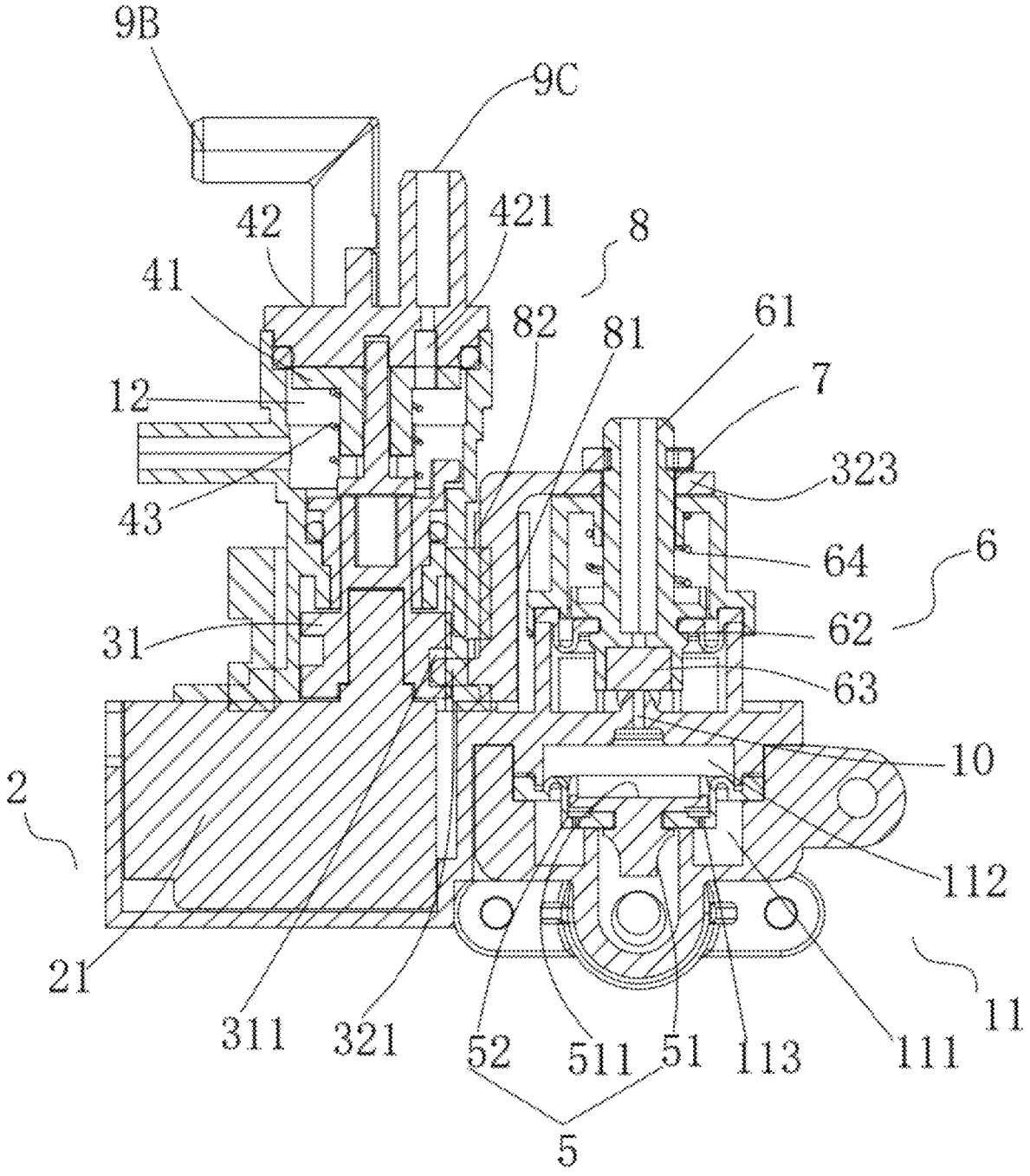
FIG. 6 is a cross-sectional view of an integrated control valve according to the present disclosure.

As shown in FIG. 3 and FIG. 4, the linkage assembly 3 is configured to drive the water inlet assembly 5 arranged inside the water inlet cavity 11 to move in an axial direction of the valve shell 1, so as to cause the water inlet assembly 5 to start and stop the communication between the water inlet cavity 11 and the water distribution cavity 12.

The linkage assembly 3 in this embodiment includes the bridging sleeve 31 and a straight movable rod 32.

One end of the bridging sleeve 31 fixedly sleeves over the output shaft of the driving member 2, and the other end of it is connected to the water distribution assembly 4.

The bridging sleeve 31 of this embodiment has columnar structure, and a ring slot 311 is provided in an outer circumferential wall of the bridging sleeve. One end of the straight movable rod 32 is inserted into the ring slot 311, and a recessed portion 312 is formed in the ring slot 311 in the axial direction. The recessed portion 312 is configured to sink one end of the straight movable rod 32, so that the straight movable rod 32 can move downward a distance. In addition, it should be noted that in this embodiment, one end of the straight movable rod 32 is provided with a protrusion 321. The protrusion 321 is vertically formed on an axis of the bridging sleeve 31 and is always maintained in the ring slot 311. As the bridging sleeve 31 rotates, the protrusion 321 is inserted into the recessed portion 312 or located at the bottom of the ring slot 311, namely, the protrusion 321 changes between the two positions, thus achieving upward and downward movement of the straight movable rod 32 in the axial direction.

One end of the straight movable rod 32 acts on the water inlet assembly 5.

The driving member 2 drives the bridging sleeve 31 to rotate, which drives the straight movable rod 32 to move or swings linearly in the axial direction of the valve shell 1, so that it can drive the water inlet assembly 5 to move in the axial direction of the valve shell 1, to open or close the water inlet cavity 11, and drive the water distribution assembly 4 to switch between opening and closing of any water outlet path 9.

The straight movable rod 32 includes three portions arranged perpendicularly to each other, namely the protrusion 321, a straight rod portion 322, and a sleeving portion 323. The sleeving portion 323 corresponds to a pilot movable structure 6 of the water inlet assembly 5, and is fixed by a clamping ring 7 after sleeving, to prevent the straight movable rod 32 from being separated from a movable rod 61 of the pilot movable structure 6. Furthermore, the straight rod portion 322 cooperates with the valve shell 1, and the entire straight movable rod 32 is limited from doing axial linear movement relative to the valve shell 1 by a limiting structure 8. It should be noted that the axial linear movement is only one way for illustration, and other structures, such as a lever, that can achieve displacement changes by swinging, rotation, and the like can also be used. In this embodiment, the straight movable rod 32 is limited by a limiting structure 8 to move axially and linearly relative to the valve shell 1. The limiting structure 8 includes a sliding chute 81 provided in the valve shell 1 and a sliding guide portion 82 on the straight movable rod 32. The sliding guide portion 82 moves in the sliding chute 81 to make one end of the straight movable rod 32 to be confined in the ring slot 311 and cause the water inlet assembly 5 at the other end of the straight movable rod 32 to move linearly in the axial direction of the valve shell 1.

The water distribution assembly 4 moves circumferentially under the action of the driving member 2, so that the water distribution cavity 12 enable to switch and be in communication with any water outlet path 9. In this embodiment, the water outlet paths 9 are respectively configured as a water outlet path 9A for hip washing, a water outlet path 9B for women's washing, and a water outlet path 9C for self-cleaning.

Water in the water distribution cavity 12 is introduced into any water outlet path 9 through the water distribution assembly 4, such as the water outlet path 9A for hip washing, the water outlet path 9B for women's washing, and the water outlet path 9C for self-cleaning. In this embodiment, the water distribution assembly 4 includes a rotating member 41 and a fixed member 42 that are cooperate with each other. The fixed member 42 is provided with water outlet holes 421 which are correspondingly in communication with the water outlet paths 9 (i.e. the water outlet path 9A for hip washing, the water outlet path 9B for women's washing, and the water outlet path 9C for self-cleaning). The rotating member 41 is connected to the bridging sleeve 31 in a non-rotation manner and is provided with a water passage hole 411 (this water passage hole 411 is eccentric arranged). The rotating member 41 rotates with the bridging sleeve 31 to drive the water passage hole 411 in the rotating member 41 to be in communication with any water outlet hole 421, so that water in the water distribution cavity 12 is sprayed out from the corresponding water outlet hole 421.

In addition, an elastic member 43 is arranged between the rotating member 41 and the bridging sleeve 31 to make the rotating member 41 hermetically press against the fixed member 42. Then this ensures that the rotating member 41 and the fixed member 42 always abut against each other to prevent water leakage from a gap therebetween, thus improving the reliability of the entire structure.

The water inlet assembly 5 includes a guide seat 51, a first membrane 52, and a pilot movable structure 6.

A periphery of the guide seat 51 is hermetically sleeved with the first membrane 52, and the water inlet cavity 11 is divided into a water inlet chamber 111 and a pressure stabilizing chamber 112 by a sealing membrane. The water inlet chamber 111 here is in communication with mixed water or municipal water. The guide seat 51 cooperates with the first membrane 52 to block the water inlet chamber 111. Drainage holes 113 for communicating the water inlet chamber 111 with the pressure stabilizing chamber 112 are correspondingly provided in the first membrane 52 and/or the guide seat 51 (the guide seat 51 here plays a guide role to ensure that the first membrane 52 can seal the water inlet chamber 111). Water is slowly introduced into the pressure stabilizing chamber 112 through the drainage holes 113. After the pressure stabilizing chamber 112 is filled, its pressure is greater than the pressure of the water inlet chamber 111, that is, a pressure on the surface of the first membrane 52 located in the pressure stabilizing chamber 112 is greater than a pressure on the surface of the first membrane 52 located in the water inlet chamber 111, so that the first membrane 52 can block the water inlet chamber 111. The guide seat 51 is located inside the pressure stabilizing chamber 112 and has a pressure bearing surface 511. The pressure bearing surface 511 is configured to withstand a water pressure, so that the first membrane 52 can cover the water inlet chamber 111. The valve shell 1 is further provided with a pressure relief hole 10, and the pressure relief hole 10 is opened or closed under the action of the pilot movable structure 6.

In this embodiment, the pilot movable structure 6 includes a movable rod 61, a second membrane 62, and a sealing plug 63.

One end of the movable rod 61 is detachably and fixedly connected to the sleeving portion 323 of the straight movable rod 32 (the sleeving portion 323 of the straight movable rod 32 sleeves over the movable rod 61' one end that is exposed out of the valve shell 1, and then is fixed by the clamping ring 7), and the sealing plug 63 is arranged at the other end. The sealing plug 63 corresponds to the pressure relief hole 10. The second membrane 62 is hermetically sleeved between the movable rod 61 and the valve shell 1, and deforms for sealing with the axial movement of the movable rod 61. It should be noted that using the second membrane 62 in this embodiment has a significant advantage. First of all, the second membrane 62 achieves a sealing effect, which means that water for pressure relief is less likely to flow out from a gap between the movable rod 61 and the valve shell 1, thus providing a good sealing effect and lowering the difficulty of manufacturing. Even if the precision of cooperation between the movable rod 61 and a hole axis of the valve shell 1 is slightly poor, the second membrane 62 can still achieve sealing without leakage. Meanwhile, to reduce friction between the movable rod 61 and the valve shell 1, the existing method is similar to a piston mode, for example, a periphery of the movable rod 61 is in contact with an inner side wall of the valve shell 1 or is matched with an O-ring or a V ring. In this way, a friction force increases (namely, a driving force also increases, which leads to an increase in the driving power of the driving member 2). Over time, a sealing member is prone to damage and cannot be used normally, leading to a short service life. In the present disclosure, the friction force is changed into an elastic force of the second membrane 62, which has better stability, better sealing performance, and longer service life. In addition, the second membrane 62 can also have elastic deformation to achieve a buffer effect when flushed by water, so as to have a pressure regulation function.

In addition, the pressure relief hole 10 is in communication with the water distribution cavity 12, so that the water flowing out of the pressure relief hole 10 is directly introduced into a distribution cavity, ensuring that the resistance to movement of the movable rod 61 is low.

The pilot movable structure 6 further includes a compensation spring 64. The compensation spring sleeves over the movable rod 61 and has two ends respectively acting on an inner surface of the valve shell 1 and the movable rod 61. This arrangement ensures that the movable rod 61 can stably stop for blocking when driving the sealing plug 63 to block the pressure relief hole 10, so that the hole is not easily opened under impact, and the response speed for blocking is increased.

In Actual Use:

(1) When a control assembly sends a cleaning instruction or an electrical signal to the driving member 2 (the stepping motor 21 is taken as an example), the power supply unit supplies power to the stepping motor 21. In this case, the stepping motor 21 drives the rotation of the bridging sleeve 31 that cooperates with the output shaft in a non-rotation manner.

(2) During the rotation of the bridging sleeve 31, the protrusion 321 that originally falls into the recessed portion 312 moves upward along an inclined surface of the recessed portion 312 into the ring slot 311. In this case, the protrusion 321 moves upward a certain distance in the axial direction of the valve shell 1, so as to drive the entire straight movable rod 32 to move upward. Due to the cooperation between the sliding guide portion 82 on the straight movable rod 32 and the sliding chute 81, the straight movable rod 32 is ensured to linearly move a certain distance, and the movable rod 61 that is fixedly connected to the straight movable rod 32 is lifted upward.

(3) When the movable rod 61 is lifted upward, the compensation spring 64 is firstly compressed, and drives the sealing plug 63 to move upward. After the sealing plug 63 moves, the pressure relief hole 10 is opened. In this case, the water that fills the pressure stabilizing chamber 112 in an original state is discharged from the pressure relief hole 10. The pressure in the pressure stabilizing chamber 112 instantly decreases, and as the water continues to decrease, the pressure decreases. When the pressure is less than the pressure in the water inlet chamber 111, the water may break through the first membrane 52 and the guide seat 51, and the water can smoothly enter the water inlet chamber 111 and then enter the water distribution cavity 12 through a hose.

(4) When the bridging sleeve 31 rotates to drive the straight movable rod 32 to move, the bridging sleeve 31 also drives the rotating member 41 to rotate relative to the fixed member 42, so that the water passage hole 411 of the rotating member 41 corresponds to one of the water outlet paths 9 (such as the water outlet path 9A for hip washing). In this case, the water flows into the water distribution cavity 12, then passes through the water passage hole 411, and is finally discharged from the water outlet path 9A for hip washing, to achieve a hip washing function. By rotation at an angle, the water passage hole 411 of the rotating member 41 corresponds to another water outlet path 9 (the water outlet path 9B for women's washing). In this case, the water flows into the water distribution cavity 12, then passes through the water passage hole 411, and is finally discharged from the water outlet path 9B for women's washing, to achieve a women's washing function. By rotation at an angle, the rotating member 41 corresponds to the water outlet path 9C for self-cleaning to achieve a self-cleaning function. In this implementation, the self-cleaning function corresponds to the recessed portion 312.

(5) After the flushing is completed, the protrusion 321 falls back to the recessed portion 312. In this case, the straight movable rod 32 moves linearly downward. Under the action of the compensation spring 64, the movable rod 61 moves downward and drives the sealing plug 63 to block the pressure relief hole 10. In this case, the water continues to flow in and enters the pressure stabilizing chamber 112 through the drainage hole 113 for continuous filling. In addition, due to the pressure bearing surface 511 on the guide seat 51 of the pressure stabilizing chamber 112, a water pressure acts on the pressure bearing surface 511 to drive the first membrane 52 to move toward the water inlet chamber 111 until the pressure in the pressure stabilizing chamber 112 is greater than that in the water inlet chamber 111. Thereby it causes the first membrane 52 to cover the water inlet chamber 111 again. Now, the entire use process is completed.

The integrated control valve for the smart toilet provided by the present disclosure, which is characterized by a simple structure, easy manufacturing, easy implementation, and low cost. It addresses the problems associated with the control valve of the existing smart toilet, such as many components, a large volume, requiring high driving power, and being not conductive to layout of the entire smart device. The present disclosure changes the existing driving mode. Water inlet and outlet functions and switching functions of the components are achieved through one driving member only, so that the costs of the components are reduced, and a demand for power during opening or closing is lowered. The power for turning on or turning off the driving member is greatly reduced, which means that more power can be saved. For the existing driving mode, in the event of power loss, a valve cannot work, unless a power storage battery is used to supply power, but the valve cannot be triggered to be turned on by a capacitor. It should be noted here that the power storage battery can turn on each existing electromagnetic valve once in the power loss state, but it has high costs and a large volume which occupies a large space. This has a great impact on the design of the entire cover plate and hinder the production of a small-sized cover plate. The present disclosure uses the integrated design in which a plurality of structures are simultaneously driven to act in a synchronous and linked manner by one driving member. More importantly, the components have simple linkage structures and act and cooperate smoothly. In this way, it is stable in subsequent assembling, formation and use. In addition, it greatly improves the layout of the entire intelligent cover plate. Furthermore, the linkage structure used in the present disclosure can synchronously achieve the switch function and the switching function to reduce a time difference, which makes the use experience better.

The above descriptions of the specification and the embodiments are intended to explain the scope of protection of the present disclosure, but does not constitute a limitation on the scope of protection of the present disclosure.

What is claimed is:

1. An integrated control valve for a smart toilet, wherein the integrated control valve comprises a valve shell, a driving member, a linkage assembly, a water distribution assembly, and a water inlet assembly;

the valve shell has a water inlet cavity and a water distribution cavity; one end of the water inlet cavity is in communication with a water inlet path, and the other end of the water inlet cavity is in communication with the water distribution cavity;

the driving member is arranged at the valve shell and is configured to: drive the water distribution assembly to rotate circumferentially relative to the valve shell and drive the linkage assembly to move axially relative to the valve shell;

the linkage assembly is configured to drive the water inlet assembly arranged inside the water inlet cavity to move axially relative to the valve shell, so as to cause the water inlet assembly to start or stop the communication between the water inlet cavity and the water distribution cavity; and the water distribution assembly moves circumferentially under the action of the driving member, so that the water distribution cavity can switch and be in communication with any water outlet path.

2. The integrated control valve for the smart toilet according to claim 1, wherein the water outlet paths are respectively configured as a water outlet path for hip washing, a water outlet path for women's washing, and a water outlet path for self-cleaning.

3. The integrated control valve for the smart toilet according to claim 2, wherein the linkage assembly comprises a bridging sleeve and a straight movable rod; one end of the bridging sleeve fixedly sleeves over an output shaft of the driving member, and the other end of the bridging sleeve is connected to the water distribution assembly; an outer circumferential wall of the bridging sleeve is provided with a ring slot, and a recessed portion is formed in the ring slot in an axial direction;

one end of the straight movable rod acts on the water inlet assembly, and the other end of it is pressed inside the ring slot; when the driving member drives the bridging sleeve to rotate, the straight movable rod is linked to linearly move or swing in the axial direction of the valve shell, so that it can drive the water inlet assembly to move in the axial direction of the valve shell to open or close the water inlet cavity, and drive the water distribution assembly to switch between opening and closing of any water outlet path.

4. The integrated control valve for the smart toilet according to claim 3, wherein the straight movable rod is limited by a limiting structure to move linearly in the axial direction relative to the valve shell; the limiting structure comprises a sliding chute provided in the valve shell and a sliding guide portion on the straight movable rod; and the sliding guide portion moves in the sliding chute to make one end of the straight movable rod be confined in the ring slot and cause the water inlet assembly at the other end of the straight movable rod to move linearly in the axial direction of the valve shell.

5. The integrated control valve for the smart toilet according to claim 2, wherein the water inlet assembly comprises a guide seat, a first membrane, and a pilot movable structure; a periphery of the guide seat is hermetically sleeved with the first membrane, and the water inlet cavity is divided into a water inlet chamber and a pressure stabilizing chamber by a sealing membrane; drainage holes for communicating the water inlet chamber with the pressure stabilizing chamber are correspondingly provided in the first membrane and the guide seat; the guide seat is located inside the pressure stabilizing chamber and has a pressure bearing surface; the pressure bearing surface is configured to withstand a water pressure to allow the first membrane to cover the water inlet chamber; the valve shell is further provided with a pressure relief hole; and the pressure relief hole is opened or closed under the action of the pilot movable structure.

6. The integrated control valve for the smart toilet according to claim 3, wherein the water inlet assembly comprises a guide seat, a first membrane, and a pilot movable structure; a periphery of the guide seat is hermetically sleeved with the first membrane, and the water inlet cavity is divided into a water inlet chamber and a pressure stabilizing chamber by a sealing membrane; drainage holes for communicating the water inlet chamber with the pressure stabilizing chamber are correspondingly provided in the first membrane and the guide seat; the guide seat is located inside the pressure stabilizing chamber and has a pressure bearing surface; the pressure bearing surface is configured to withstand a water pressure to allow the first membrane to cover the water inlet chamber; the valve shell is further provided with a pressure relief hole; and the pressure relief hole is opened or closed under the action of the pilot movable structure.

7. The integrated control valve for the smart toilet according to claim 4, wherein the water inlet assembly comprises a guide seat, a first membrane, and a pilot movable structure; a periphery of the guide seat is hermetically sleeved with the first membrane, and the water inlet cavity is divided into a water inlet chamber and a pressure stabilizing chamber by a sealing membrane; drainage holes for communicating the water inlet chamber with the pressure stabilizing chamber are correspondingly provided in the first membrane and the guide seat; the guide seat is located inside the pressure stabilizing chamber and has a pressure bearing surface; the pressure bearing surface is configured to withstand a water pressure to allow the first membrane to cover the water inlet chamber; the valve shell is further provided with a pressure relief hole; and the pressure relief hole is opened or closed under the action of the pilot movable structure.

8. The integrated control valve for the smart toilet according to claim 5, wherein the pilot movable structure comprises a movable rod, a second membrane, and a sealing plug; one end of the movable rod is detachably and fixedly connected to the straight movable rod, and the sealing plug is arranged at the other end of the movable rod; the sealing plug corresponds to the pressure relief hole; the second membrane is hermetically sleeved between the movable rod and the valve shell, and can deform for sealing with the axial movement of the movable rod; and the pressure relief hole is in communication with the water distribution cavity.

9. The integrated control valve for the smart toilet according to claim 6, wherein the pilot movable structure comprises a movable rod, a second membrane, and a sealing plug; one end of the movable rod is detachably and fixedly connected to the straight movable rod, and the sealing plug is arranged at the other end of the movable rod; the sealing plug corresponds to the pressure relief hole; the second membrane is hermetically sleeved between the movable rod and the valve shell, and can deform for sealing with the axial movement of the movable rod; and the pressure relief hole is in communication with the water distribution cavity.

10. The integrated control valve for the smart toilet according to claim 7, wherein the pilot movable structure comprises a movable rod, a second membrane, and a sealing plug; one end of the movable rod is detachably and fixedly connected to the straight movable rod, and the sealing plug is arranged at the other end of the movable rod; the sealing plug corresponds to the pressure relief hole; the second membrane is hermetically sleeved between the movable rod and the valve shell, and can deform for sealing with the axial movement of the movable rod; and the pressure relief hole is in communication with the water distribution cavity.

11. The integrated control valve for the smart toilet according to claim 8, wherein the pilot movable structure further comprises a compensation spring; the compensation spring sleeves over the movable rod and has two ends respectively acting on an inner surface of the valve shell and the movable rod.

12. The integrated control valve for the smart toilet according to claim 11, wherein the water distribution assembly comprises a rotating member and a fixed member that are cooperate with each other; the fixed member is provided with water outlet holes which are correspondingly in communication with the water outlet paths; the rotating member is connected to the bridging sleeve in a non-rotation manner and is provided with a water passage hole; and the rotating member rotates with the bridging sleeve to drive the water passage hole in the rotating member to be in communication with any water outlet hole of the fixed member, so that water in the water distribution cavity is sprayed out from the corresponding water outlet holes.

13. The integrated control valve for the smart toilet according to claim 12, wherein the water distribution assembly further comprises an elastic member; and two ends of the elastic member respectively act on the rotating member and the bridging sleeve to make the rotating member hermetically press against the fixed member.

14. The integrated control valve for the smart toilet according to claim 1, wherein the driving member is a motor, and the motor is respectively connected to a power supply unit and a power storage capacitor.

* * * * *